United States Patent [19]

Furnari

[11] 4,016,989

[45] Apr. 12, 1977

[54] WORK HANDLING APPARATUS

[76] Inventor: Anthony Furnari, 107 Greenview Drive, Indiana, Pa. 15701

[22] Filed: May 20, 1975

[21] Appl. No.: 579,256

[52] U.S. Cl. ..... 214/38 R; 214/38 BA; 214/44 C; 214/46.28; 214/77 R; 271/175

[51] Int. Cl.[2] ..... B65G 67/02

[58] Field of Search ..... 214/38 B, 38 BA, 44 R, 214/44 C, 45, 46, 46.24, 46.28, 46.34, 77 R, 315, 301, 318; 112/217.1; 186/1 A, 1 AC; 271/175

[56] References Cited

UNITED STATES PATENTS

| | | | |
|---|---|---|---|
| 3,205,976 | 9/1965 | Stollman | 186/1 AC |
| 3,513,944 | 5/1970 | McConnaughhay | 186/1 AC |
| 3,596,785 | 8/1971 | Weatherford | 214/38 BA |
| 3,704,884 | 12/1972 | Nicolay et al. | 271/175 |
| 3,712,609 | 1/1973 | Robert | 271/175 |

*Primary Examiner*—Trygve M. Blix
*Assistant Examiner*—Charles E. Frankfort
*Attorney, Agent, or Firm*—Clarence A. O'Brien; Harvey B. Jacobson

[57] ABSTRACT

A stack of workpiece fabrics carried on a mobile cart is brought to a sewing machine having a work surface spaced above the table surface of the cart on which the fabric is supported. An air powered lift mechanism mounted on the sewing machine and engaged with the cart elevates the cart to an upper tilted position for easy transfer of the work from the table surface of the cart to the work surface of the sewing machine. Fabrics on which work has been completed may be transferred by air powered apparatus to a cart for transport to another station.

8 Claims, 8 Drawing Figures

WORK HANDLING APPARATUS

BACKGROUND OF THE INVENTION

This invention relates to the transfer of stacks of fabric or garments between the work surface of a sewing machine and a lower supporting surface of a mobile cart.

In garment manufacturing plants, bundles or stacks of cut or partially finished fabric workpieces are generally transported by mobile carts between sewing stations. At each sewing station the stack of fabric is generally lifted off the cart and placed on the work surface of the sewing machine at a higher level by the machine operator. Also, after a stack of fabric has been stitched, it is bundled and manually placed on a cart for transport to another station. The foregoing handling of the fabric stacks by the sewing machine operator reduces production rates and contributes to operator fatigue. It is therefore an important object of the present invention to provide a system for transferring stacks of fabric between the supporting surfaces of sewing machines and mobile carts with greater ease and convenience in order to lower operator fatigue and increase overall production speed in the manufacture of garments.

Although power operated lifts for elevating and tilting of mobile or wheeled devices are well known as disclosed for example in U.S. Pat. Nos. 2,928,562 and 3,142,397, such apparatus are designed for unloading of receptacles into trash collection vehicles. No comparable power operated mechanisms have been devised for enhancing the transfer of work between otherwise horizontal surfaces at different levels, including the elevation of the lower horizontal surface to that of the higher surface and the tilting of the raised surface by a limited amount.

SUMMARY OF THE INVENTION

In accordance with the present invention, a work station such as the tabletop of a sewing machine has associated therewith a power operated lift mechanism adapted to engage a wheeled cart for raising its top supporting surface to the level of the sewing machine and slightly tilting the cart so as to facilitate the sliding of a stack of fabric from the cart onto the work surface of the sewing machine. Further, the standard fabric stacker sometimes associated with a sewing machine is eliminated in favor of another power operated transfer device which sequentially clamps draped fabric to the mobile cart and displaces it onto the lower supporting surface of the cart to replace manual transfer operations.

BRIEF DESCRIPTION OF THE DRAWING FIGURES

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
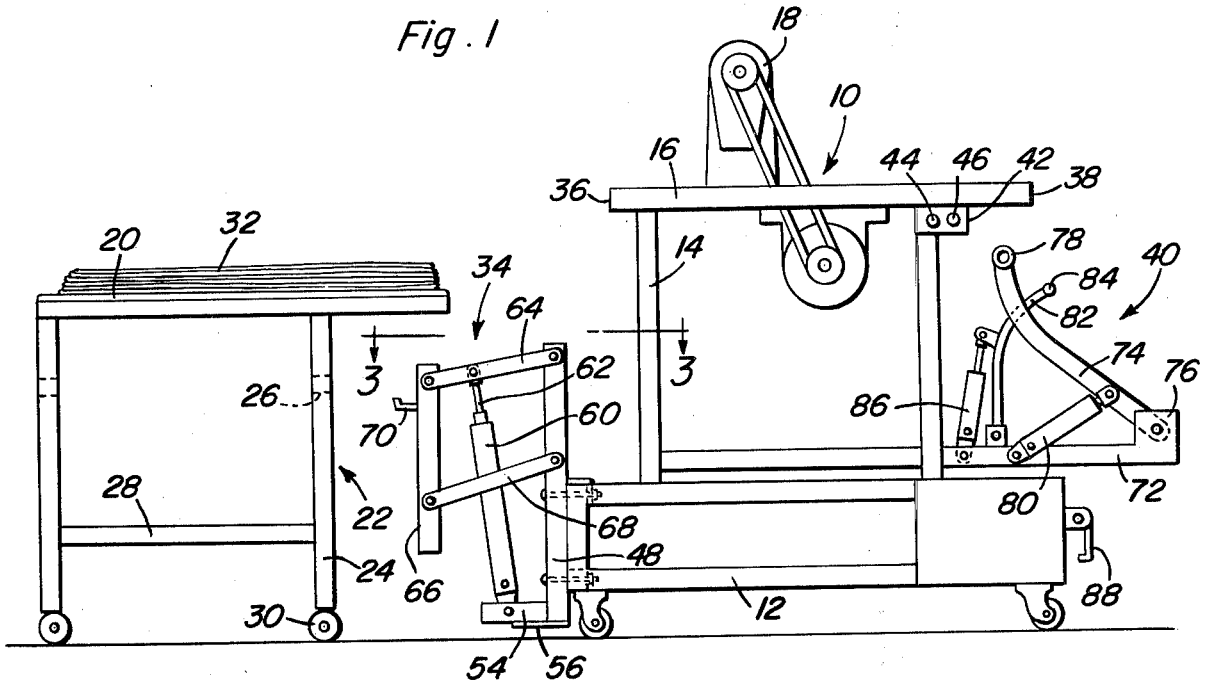
FIG. 1 is a side elevation view of a sewing machine equipped with the apparatus of the present invention and a wheeled, work carrying cart.

Referring now to the drawings in detail, FIG. 1 illustrates a typical industrial sewing machine generally referred to by reference numeral 10 having a base 12 from which frame legs 14 rise to support a horizontal work table or surface 16 on which a garment stitching mechanism or sewing head 18 is mounted. The work surface 16 is at a higher level than the supporting table surface 20 of a mobile transport device or wheeled cart 22 having corner legs 24 interconnected by upper and lower cross frame members 26 and 28, with caster wheels 30 at the bottom of the legs. As shown, a bundle of fabrics or garments 32 to be sewn is carried on the cart for transport to the sewing machine 10.

With continued reference to FIG. 1, a power operated lift mechanism generally denoted by reference numeral 34 is secured to the frame of the machine 10 below that side 36 of the work surface 16 adapted to receive a bundle of workpieces 32. Below the other side 38 from which completed work may drape, a work transfer device 40 is secured to the machine frame. A control panel 42 mounting push-buttons 44 and 46 may be mounted at any suitable location on the machine for actuation of the lift mechanism 34 or work transfer device 40.

Figure 2:
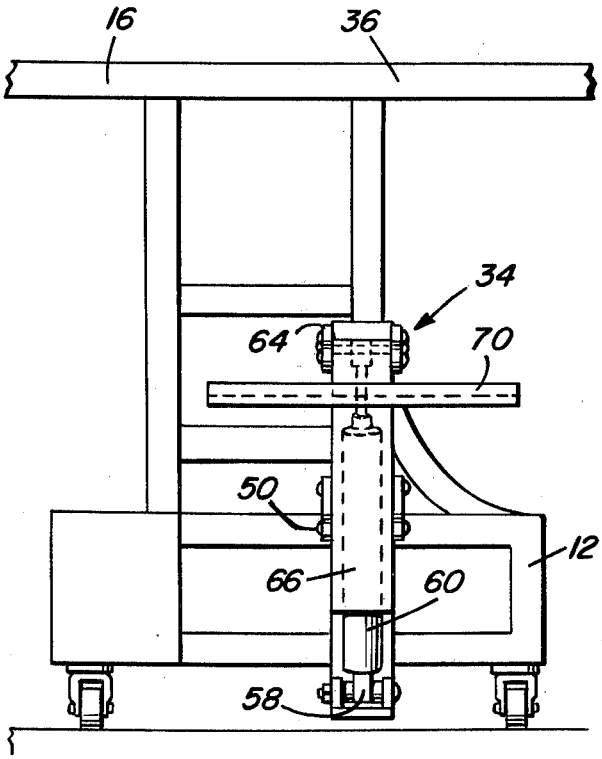
FIG. 2 is a front elevation view of the power operated lift mechanism installed on the sewing machine.
Figure 3:
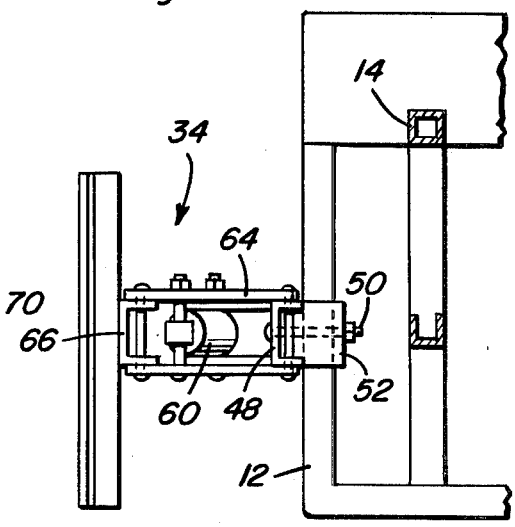
FIG. 3 is a top section view taken substantially through a plane indicated by section line 3—3 in FIG. 1.

As shown in FIGS. 1, 2 and 3, the lift mechanism includes a frame post 48 secured to the base 12 of the sewing machine by means of fastener assemblies 50 and braket 52 as seen in FIG. 3. A base leg 54 extends at right angles from the lower end of frame post 48 closely spaced above the floor and interconnected with the post 48 by a base plate 56. Pivotally connected to the base leg 54 is an anchor element 58 at one axial end of an air cylinder device 60. A piston rod 62 extends from the other axial end of the air cylinder device upwardly and is pivotally connected to a pair of upper links 64 which are pivotally interconnected at opposite ends to the upper end portion of the frame post 48 and to a lift column member 66. A pair of lower links 68 are also pivotally interconnected at opposite ends to the frame post and the lift column 66 in straddling relation to the air cylinder device 60. As seen in FIG. 1, the links 64 and 68 are in non-parallel relation to each other.

Figure 4:
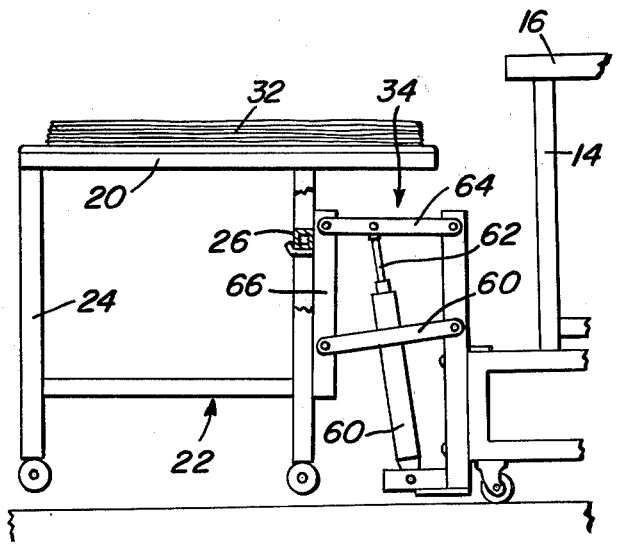
FIG. 4 is a partial side elevation view with parts broken away and shown in section, of the wheeled cart being elevated by the power operated lift mechanism.
Figure 5:
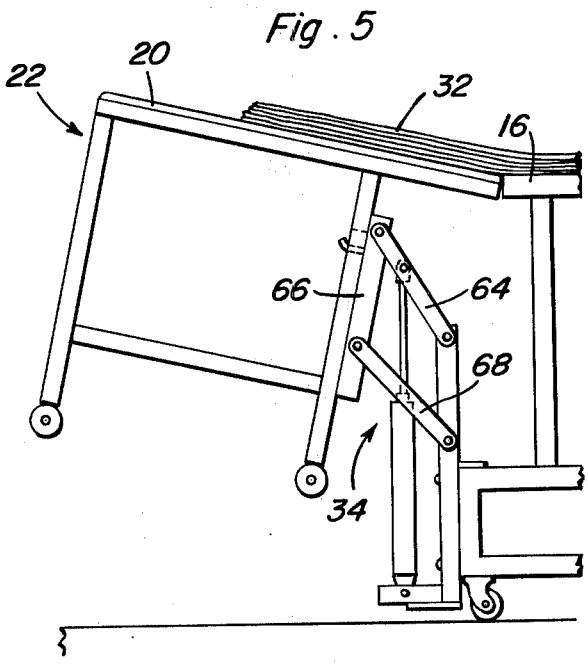
FIG. 5 is a partial side elevation view showing the cart elevated and tilted in its upper position.

Secured to the lift column 66 is a laterally elongated hook element 70 adapted to be received below a cross frame member 26 of the cart when wheeled into abutment with the lift column in its lower position as shown in FIG. 1. The lift column may then be elevated as shown in FIG. 4 by actuation of the push-button 44 causing extension of the piston rod 62 from the air cylinder device 60. When the lift column reaches its upper position as shown in FIG. 5, the table surface 20 of the cart will be abutting the work surface 16 at the same level and slightly tilted because of the non-parallel relationship between the links 64 and 68. The workpieces 32 may therefore be easily slid onto the work surface 16 from the cart.

The work transfer device 40 as shown in FIG. 1 is mounted on a frame extension 72 of the machine above the base 12 and includes a lever 74 pivotally supported by pivot bracket 76. A transversely extending bar 78 is connected to the upper end of the lever while an air cylinder device 80 pivotally anchored to the frame extension 72 has its piston rod pivotally connected to the lever 74 intermediate the pivot bracket 76 and the rod 78. A clamping lever 82 has a transversely extending rod 84 at its upper end below the rod 78. The lever 82 is also pivotally mounted on the frame extension and extends outwardly from the machine in crossing relation to the lever 74. An air cylinder device 86 pivotally anchored to the frame extension, has its piston rod pivotally connected to the lever 82.

Figure 6:
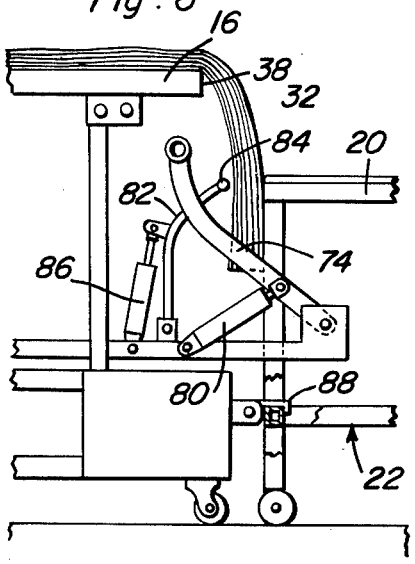
FIG. 6 is a partial side elevation view showing the clamping of draped fabric to a cart by the work transfer device.
Figure 7:
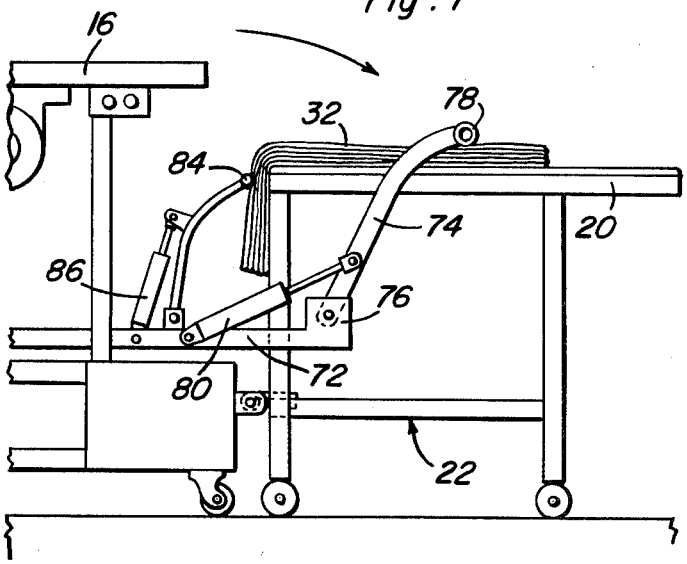
FIG. 7 is a partial side elevation view showing transfer of the work.

As shown in FIG. 6, a cart 22 is releasably anchored to the frame of the sewing machine by an anchoring hook 88 so that finished workpieces 32 draped over the edge 38 of the work surface 16 may be clamped to the adjacent edge of the table surface 20 of the cart by the rod 84 at the upper end of lever 82. The lever 82 is displaced clockwise as viewed in FIG. 6, for this purpose, by extension of the piston rod from the air cylinder device 86. The lever 74 which straddles lever 82 as well as the cart 22 is than displaced clockwise to the position shown in FIG. 7 so that its rod 78 may flip the stack of fabric 32 over onto the table surface 20. Movement of the levers 82 and 74 by the air cylinder devices 86 and 80 may be effected in sequence by actuation of the push-button 46 in order to automatically transfer the workpieces to the cart.

Figure 8:
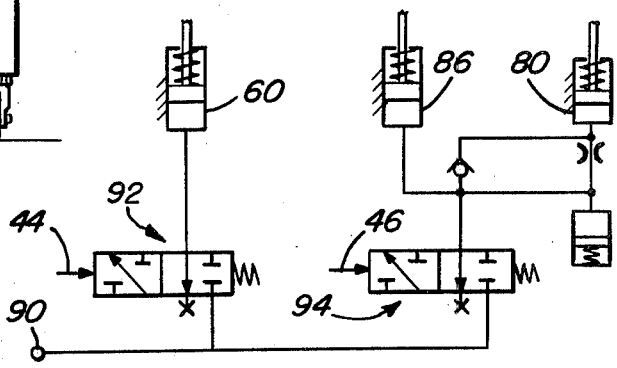
FIG. 8 is a schematic fluid circuit diagram of a typical control system associated with the power operated lift and work transfer devices.

As shown by way of example only in FIG. 8, air under pressure from a suitable source 90 may be supplied to the air cylinder 60 of the lift mechanism through a control valve 92 or in sequence to the air cylinder 86 and 80 through a control valve 94. The machine operator may thereby selectively operate either the lift mechanism 34 or the work transfer device 40 by actuation of the control valves through the push-buttons 44 and 46.

The foregoing is considered as illustrative only of the principles of the invention. Further, since numerous modificatons and changes will readily occur to those skilled in the art, it is not desired to limit the invention to the exact construction and operation shown and described, and accordingly all suitable modifications and equivalents may be resorted to, falling within the scope of the invention.

What is claimed as now is as follows:

1. In combination with a machine having a base and a horizontal work surface adapted to support a workpiece thereon, apparatus for transferring the workpiece between said work surface and a first transport device, including a frame attached to said base, vertically movable lift means engageable with said first transport device for elevation thereof from a lower horizontal position spaced below the work surface, link means interconnecting the frame and the lift means for constraining movement of said first transport device between said lower position and an upper tilted position downwardly inclined relative to said work surface, and power operated means connected to the link means for displacement of said first transport device to said upper position to enhance transfer of the workpiece to the work surface, said link means comprising a pair of link elements pivotally interconnected between the frame and the lift means in non-parallel relation to each other.

2. The combination of claim 1 wherein said apparatus further includes latch means mounted on the base for holding a second transport device in operative relation to the work surface, clamp means engageable with the workpiece while supported draped over the work surface for clamping of the workpiece to said second device and work displacing means engageable with the workpiece while clamped to said second device for transfer of the workpiece relative to said clamp means onto said second transport device.

3. The combination of claim 2 wherein said machine includes fabric stitching means and said workpiece is a stack of fabrics.

4. The combination of claim 3 wherein said lift means comprises a vertically elongated column to which the link means is connected, and an elongated hook element connected to the column and extending transversely thereof.

5. The combination of claim 4 wherein said first transport device comprises a mobile cart having a table surface on which the workpiece is adapted to be carried, said table surface being elevated to the level of the work surface and in abutment therewith in the upper position to which said first transport device is displaced.

6. The combination of claim 1 wherein said lift means comprises a vertically elongated column to which the link means is connected, and an elongated hook element connected to the column and extending transversely thereof.

7. The combination of claim 1 wherein said first transport device comprises a mobile cart having a table surface on which the workpiece is adapted to be carried, said table surface being elevated to the level of the work surface and in abutment therewith in the upper position to which said first transport device is displaced.

8. In combination with a machine having a base and a horizontal work surface adapted to support a workpiece thereon, apparatus for transferring the workpiece between said work surface and transport device having a supporting surface, including a frame attached to said base, vertically movable lift means for elevating the transport device from a lower position wherein said supporting surface is spaced substantially parallel to and below the work surface to an upper tilted position abutting the work surface, said lift means comprising a vertical lift column engageable with the transport device in spaced relation below the supporting surface, link means interconnecting the frame and the lift column for constraining movement of the transport device between said lower position and said upper tilted position wherein said supporting surface is downwardly inclined relative to said work surface, and power operated means connected to the link means for displacement of the transport device to said upper position to enhance transfer of the workpiece from the supporting surface to the work surface.

* * * * *